US007650967B2

(12) United States Patent
SikShin et al.

(10) Patent No.: US 7,650,967 B2
(45) Date of Patent: Jan. 26, 2010

(54) COMMUNICATING TO ELEVATOR PASSENGERS RE CAR MOVEMENT TO PIT OR OVERHEAD

(75) Inventors: Cheong SikShin, Seoul (KR); Theresa Christy, West Hartford, CT (US); Arthur Hsu, Manchester, CT (US); Hansoo Shim, Seoul (KR); Harry Terry, Avon, CT (US); Frank Sansevero, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 357 days.

(21) Appl. No.: 11/816,316

(22) PCT Filed: Feb. 17, 2005

(86) PCT No.: PCT/US2005/005072

§ 371 (c)(1),
(2), (4) Date: Aug. 15, 2007

(87) PCT Pub. No.: WO2006/088457

PCT Pub. Date: Aug. 24, 2006

(65) Prior Publication Data

US 2008/0210492 A1 Sep. 4, 2008

(51) Int. Cl.
*B66B 9/00* (2006.01)

(52) U.S. Cl. ..... 187/249; 187/391

(58) Field of Classification Search ..... 187/249, 187/391–396, 902

See application file for complete search history.

(56) References Cited

U.S. PATENT DOCUMENTS 849,840 A 4/1907 Foster (Continued)

FOREIGN PATENT DOCUMENTS

EP 1371596 A1 12/2003

(Continued)

OTHER PUBLICATIONS

International Search Report and Written Opinion of the International Searching Authority for International application No. PCT/US05/105072 mailed Jul. 18, 2006.

*Primary Examiner*—Jonathan Salata
(74) *Attorney, Agent, or Firm*—Carlson, Gaskey & Olds PC

(57) ABSTRACT

One of a plurality of cars (17, 18) traveling in a hoistway (10) of an elevator system (9) may be diverted to the hoistway overhead (31) or pit (36) to enable another of the cars to gain access to a floor near or at a terminal floor (11, 14). When such car is at its last stop with doors open, visual (40) and audible (41) indicators present (57, 58) messages to the effect that this is the last stop and passengers should exit. After car doors are closed (66), visual and audible messages (68, 69) relate to the car going to the pit or overhead and that passengers may push any button (to reopen doors). Thereafter, the car moves (75, 76) to the overhead (31) or the pit (36) and presents (82, 83) visual and audible messages to the effect that passengers did not exit at the correct floor and must wait while the other car makes a stop. Once the terminal floor is clear, the diverted car will run (87-89) to that floor, presenting (92, 93) visual and audible messages to the effect that passengers should exit once the doors are open and reenter their service requests.

8 Claims, 3 Drawing Sheets

U.S. PATENT DOCUMENTS

| | | | | |
|---|---|---|---|---|
| 974,439 | A | 11/1910 | Schwab | |
| 1,027,628 | A | 5/1912 | Schwab | |
| 1,805,227 | A | 5/1931 | Rugg | |
| 1,896,776 | A | 2/1933 | James | |
| 1,896,777 | A | 2/1933 | James | |
| 5,865,274 | A | 2/1999 | Kiji et al. | |
| 5,877,462 | A | 3/1999 | Clenais | |
| 6,273,217 | B1 | 8/2001 | Hikita | |
| 6,360,849 | B1 | 3/2002 | Hikita | |
| 6,364,065 | B1 | 4/2002 | Hikita | |
| 6,554,107 | B2 | 4/2003 | Yumura et al. | |
| 6,955,245 | B2 | 10/2005 | Dunser et al. | |
| 7,117,979 | B2 | 10/2006 | Angst et al. | |
| 7,178,635 | B2 | 2/2007 | Meissner et al. | |
| 2005/0082121 | A1 | 4/2005 | Deplazes | |
| 2005/0087402 | A1 | 4/2005 | Haegi et al. | |
| 2005/0279584 | A1 | 12/2005 | Ruter et al. | |
| 2006/0289240 | A1 | 12/2006 | Sakita | |
| 2007/0039785 | A1 | 2/2007 | Smith et al. | |
| 2008/0190705 | A1 * | 8/2008 | Terry et al. | 187/249 |

FOREIGN PATENT DOCUMENTS

| | | | | |
|---|---|---|---|---|
| EP | 1698580 | A1 | | 9/2006 |
| JP | 04173672 | A | * | 6/1992 |
| JP | 4345486 | | | 12/1992 |
| JP | 4361960 | | | 12/1992 |
| JP | 5051185 | | | 3/1993 |
| JP | 5132257 | | | 5/1993 |
| JP | 6305648 | | | 11/1994 |
| JP | 8133611 | | | 5/1995 |
| JP | 7157243 | | | 6/1995 |
| JP | 7172716 | | | 7/1995 |
| JP | 8133630 | | | 5/1996 |
| JP | 9110316 | | | 4/1997 |
| JP | 2001226050 | | | 8/2001 |
| JP | 2001240318 | | | 9/2001 |
| JP | 2001247265 | | | 9/2001 |
| JP | 2001251188 | | | 9/2001 |
| JP | 2001335244 | | | 12/2001 |
| JP | 2002220164 | | | 8/2002 |
| JP | 2002255460 | | | 9/2002 |
| JP | 2003160283 | | | 6/2003 |
| JP | 2004155519 | | | 6/2004 |

* cited by examiner

FIG.2
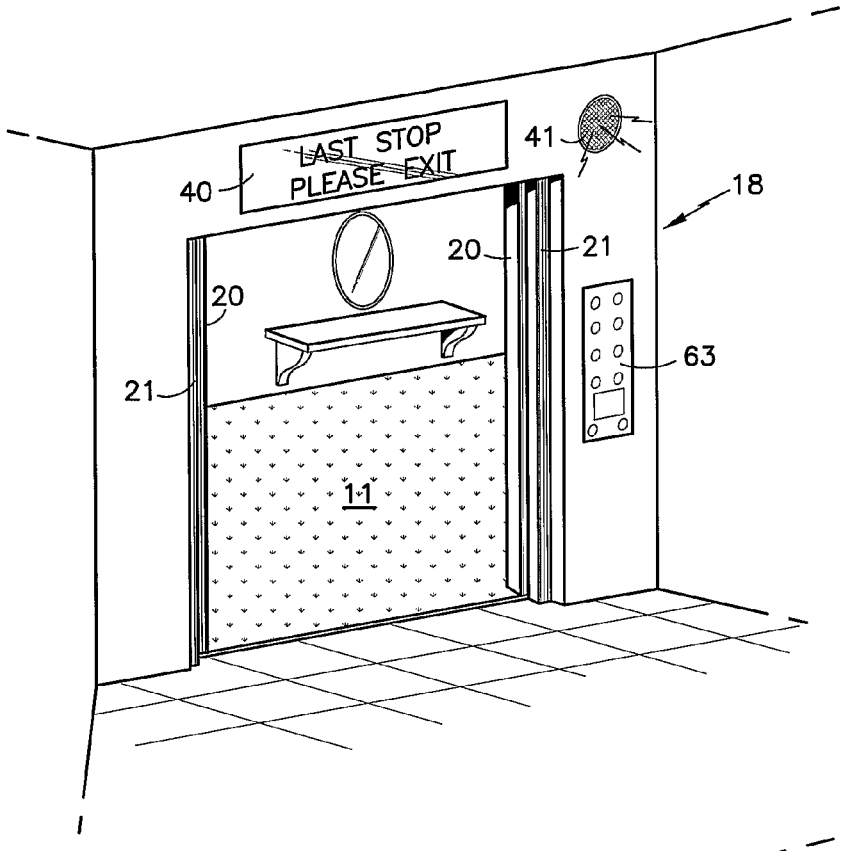
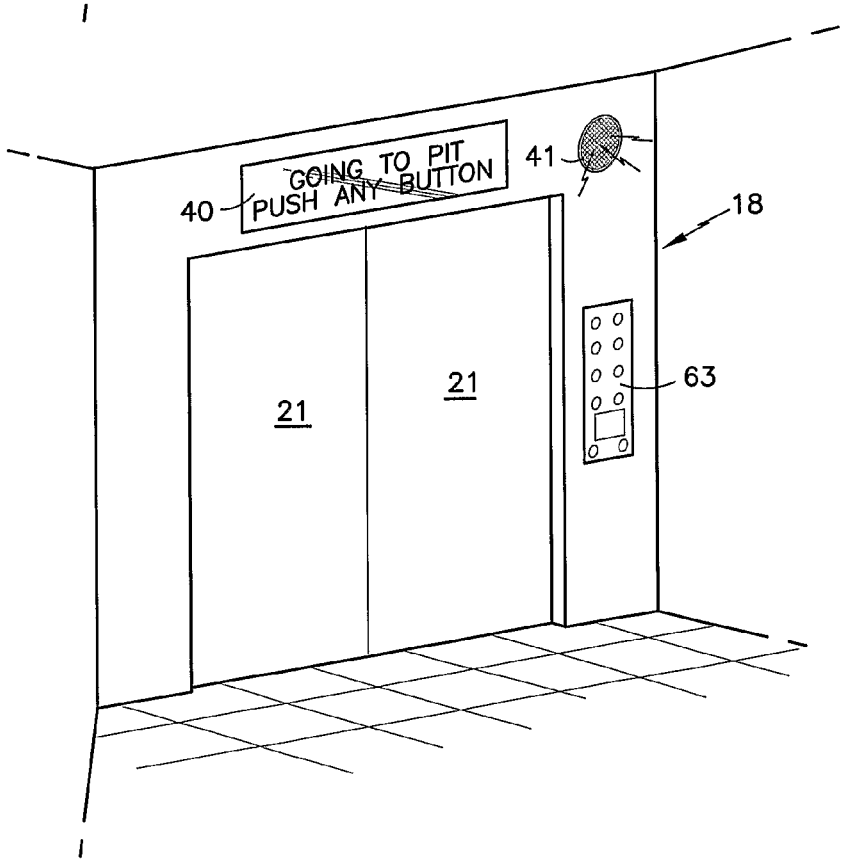
FIG.4

COMMUNICATING TO ELEVATOR PASSENGERS RE CAR MOVEMENT TO PIT OR OVERHEAD

TECHNICAL FIELD

This invention relates to providing audible and visual information to urge passengers to exit a car which is about to move either to the pit or the overhead, to wait while another car is at an adjacent terminal floor, and to leave the car when the doors open, and to reenter their calls.

BACKGROUND ART

In elevator systems having a plurality of cars in a single hoistway, the traffic capacity exceeds that of elevator systems having a single car in the hoistway. However, in order to utilize this extra capacity, the cars must all be used effectively. In order for a car that is other than the highest or the lowest car in the hoistway to provide requested service at either the upper terminal floor or the lower terminal floor, respectively, the uppermost or lowermost car, respectively, must move either to the hoistway overhead or the pit in order to provide access to the other car. If passengers are lingering in a car which is at a terminal floor and is about to move to the pit or the overhead, it is preferred that such passengers leave the car and reenter their calls for service to their original destination. If however, the passengers do not leave the car as it moves to the pit or the overhead, then it becomes obvious that the passengers have traveled to the wrong place, and missed their desired destination.

DISCLOSURE OF INVENTION

Objects of the invention include: maximizing utilization of a plurality of cars traveling in the same hoistway; assisting passengers who have missed their destination and remain in a car at a terminal floor; informing passengers that have missed their destination floor and stayed within a car that has moved to the pit or the overhead of a hoistway; assuring that passengers who have ridden in the car to the pit or the overhead of a hoistway are informed that they must leave the car when the doors next open so they may reenter a call to their desired destination; improved service in an elevator system having multiple cars in the hoistway; and communication to passengers with respect to travel which could result in reaching the pit or the overhead of a multi-car hoistway.

According to the present invention, when an elevator car is at its last stop and will next move either to the pit or the overhead of the hoistway, so that another car may gain access to a floor, the passengers are all urged to leave the car by audible and visual messages to the effect that they are at the last stop and they should leave the car. In accordance with the invention, after the car doors are closed in preparation for moving to the pit or overhead, visual and audible messages inform any potentially remaining passengers that the car is headed to the pit or overhead, and they should push any button, which would open the car doors. According further to the invention, when a car is in either the pit or the overhead, passengers are visually and audibly informed that they must wait while another car gains access to the terminal floor, and they are informed that they should leave the car when the car doors next become open, and reenter their request for service to a desired destination. In further accord with the invention, the one or more of messages may be withheld unless there is evidence that the car is not empty, such as load weight or operating panel button activity.

BRIEF DESCRIPTION OF THE DRAWINGS

FIG. 2 is a simplified, stylized perspective illustration of an elevator employing the invention with its doors open, such as at its last stop.

FIG. 4 is a simplified, perspective illustration of an elevator employing the present invention with the doors closed, as it may appear in the pit or the overhead.

MODE(S) FOR CARRYING OUT THE INVENTION

Figure 1:
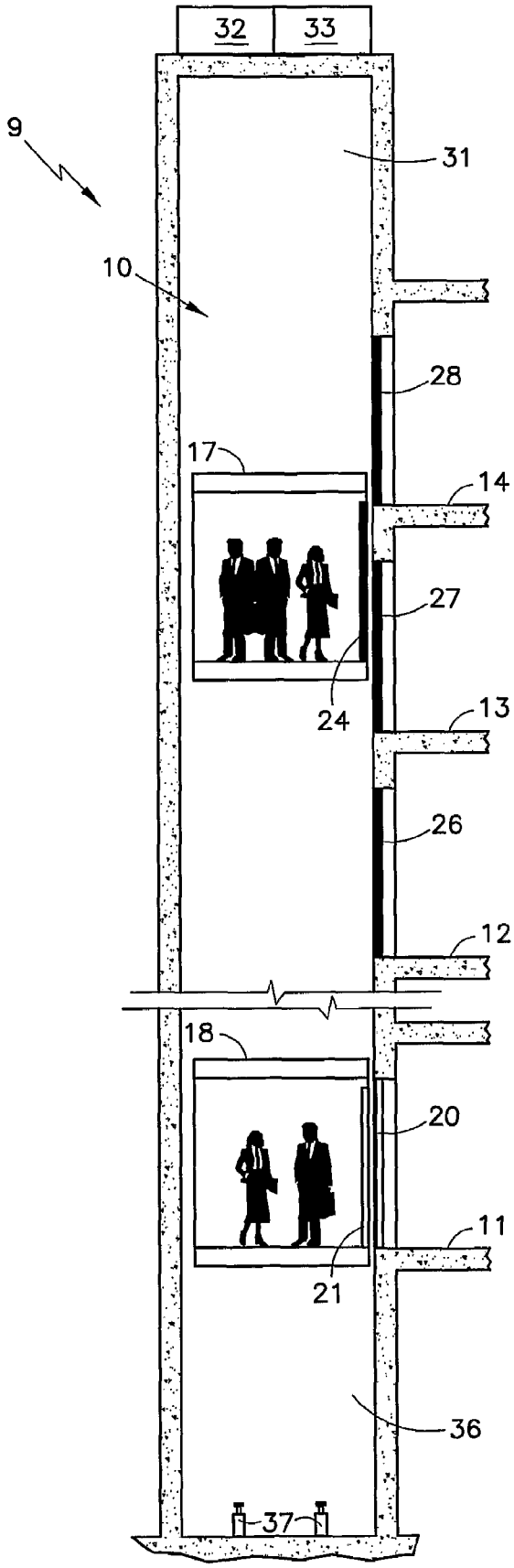
FIG. 1 is a partial, partially broken away, sectional side elevation view of an elevator system which may incorporate the present invention.

Referring to FIG. 1, an elevator system 9 serving a plurality of floors 11-14 in a building includes a hoistway 10 having an upper elevator 17 and a lower elevator 18 disposed therein. The lower elevator 18 is shown at the lowest terminal floor 11 with the doors 20, 21 of the landing and the elevator car both open. The upper elevator car is shown in motion between the floors 13, 14, with its doors 24 closed. The doors 26-28 of all the other landings 12-14 are also shown closed.

At the top of the hoistway 10 there is an overhead 31, above which may be located the machines 32 and controllers 33 for the cars 17, 18. At the bottom of the hoistway 10 there is a pit 36 in which the buffers 37 are located.

The invention is illustrated with respect to the lower car 18 traveling into the pit 36 so as to permit the upper car 17 to gain access to the lowest terminal floor 11 in order to provide passenger service to or from that floor. When the car 18 is at its last stop (having no further demand) and under the condition that the other car 17 is to have access either to that last stop or a floor beyond it, then the lower car 18 will have the pit 36 as its target floor (18). In such case, it is preferable to ensure that the passengers all leave the car at the last service floor of the car (which in the example of FIG. 1 is the lowest terminal floor 11). To achieve this, in accordance with the invention, a visual message, such as on a sign 40 within the car, as well as an audible message, such as from a loudspeaker 41 within the car, both announce to the passengers words to the effect that this is the last stop and the passengers should exit. Different words of same general import may be used on the sign and in the announcement.

Figure 3:
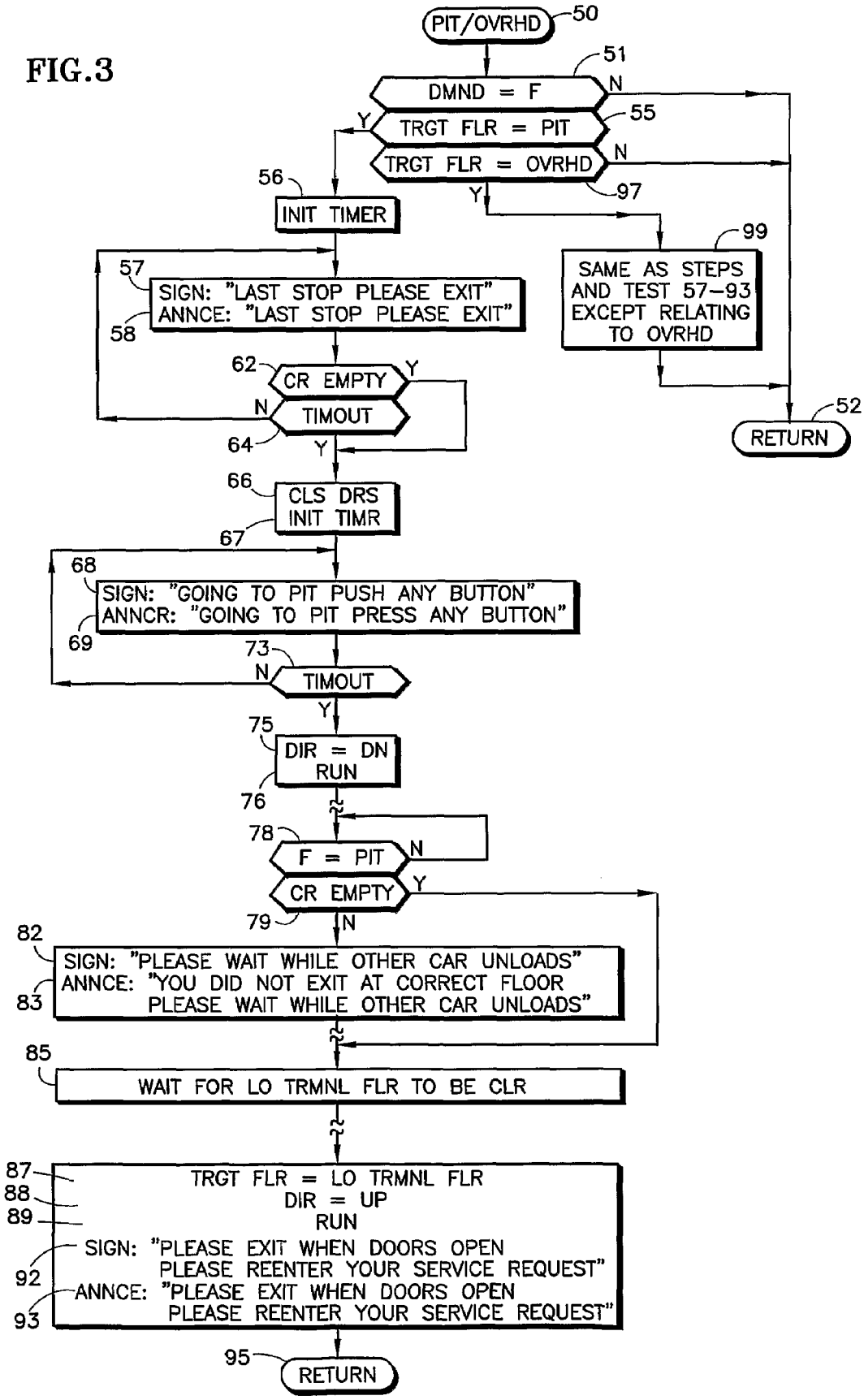
FIG. 3 is a simplified, exemplary functional diagram illustrating operational strategy which may be employed in practicing the present invention.

Referring to FIG. 3, a logic flow diagram illustrates, by way of example, functions which may be performed in order to implement the present invention. The routine may be reached through an entry point 50, and a test 51 determines if the demand for this car is its current floor position, F (e.g., car has served its final call at this floor). If not, then the subroutine is not currently necessary, so a negative result of test 51 causes reversion to other programming through a return point 52. If the car is at its last stop, an affirmative result of test 51 will reach a test 55 to determine if the target floor for the car is now the pit. If it is, then the features of the invention are to be brought into play.

A first step 56 initiates a timer; then a step 57 causes the sign 40 to display the message "last stop, please exit", a step 58 causes the loudspeaker 41 to announce "last stop, please exit".

Then a test 62 determines if the car is empty: this may be in response to the indication from a load weighing system, or the recent activity of any of the buttons in the car operating panel 63 (FIG. 2) of the car. If the car does not appear to be empty (due to load or button activity, for instance) then a step 64 determines if the timer, initiated in step 56, has timed out or not. If not, the sign will be again turned on at step 57 (or it may remain on) and another announcement may be made at step 58. This time, the timer is not initiated again.

Eventually, the timer will time out and an affirmative result of test 64 will reach a step 66 to cause the doors of the car to close. If the car appears to be empty at test 62, the doors 66 may be closed right away. If desired, the empty car determination may be made ahead of steps 57-59; however, it may be preferred, for safety sake, to light the sign and make the announcement of the invention, prior to determining whether the car appears empty or not. The empty car consideration may be eliminated, if desired. In any event, details such as these may be altered to suit any particular utilization of the invention.

Once the doors have been ordered to be closed, step 67 initiates a timer, a step 68 will cause the sign to read "going to pit, push any button", and a step 69 causes an announcement: "going to pit, press any button". Of course, other language of similar import may be used. Pushing any button would cause the doors to reopen.

A test 73 determines when the timer has timed out. Prior thereto, the sign may remain on or be turned on a second time, and a second or additional announcement may be made.

After passengers have had a chance to react to the sign and the announcement within the time out period, a step 75 will set the car direction to down and a step 76 will cause the car to run. When the floor position of the car is the pit, a test 78 will be affirmative reaching a test 79 to determine if the car appears to be empty. This may be determined in response to a variety of factors, such as the load weight and activity of the buttons on the car operating panel 63 (FIG. 2). If the car does not appear to be empty, a step 82 will cause the sign to display: "Please wait while other car unloads", and a step 83 will cause the loudspeaker 41 to announce "You did not exit at correct floor, please wait while other car unloads", or words of similar import. On the other hand, if it seems as though the car is empty, the steps 82 and 83 may be bypassed by an affirmative result of test 79.

As indicated by a block 85, the low car will wait until the low terminal floor 11 is clear. When there is no longer a conflict between the position of two cars, a step 87 will set the target floor of the low car to the low terminal floor. A step 88 sets the car direction to up, and a step 89 commands the car to run. Then, a pair of steps 92, 93 cause visual and audible messages to be made to any possible passengers that are within the car: "Please exit when doors open, please reenter your service request". Then other parts of the program are reverted to through a return point 95.

At the top of FIG. 3, if the test 51 indicates this is the last stop for the car, but test 55 is negative, then a test 97 determines if the car has a target floor of the overhead. If so, all of the tests and steps 57-93 are performed, except as relating to the overhead instead of the pit, as indicated in block 99.

The particular language and the detailed functional relationships set forth in FIG. 3 are exemplary merely, the invention being capable of implementation in a variety of ways, displaying and announcing variety of different word concepts within the purview of the invention.

The nature of the visual device (sign 40), or whether there are a plurality of signs in a car, are both irrelevant to the present invention. Similarly, one or more audible devices may differ from the loudspeaker 41 illustrated in the figures.

The invention claimed is:

1. A method of operating an elevator system including a plurality of cars movable within a hoistway having at least one parking space for parking an elevator car, said at least one parking space selected from a pit and an overhead which are capable of receiving one of said cars so as to avoid conflict between it and another of said cars, comprising the steps of:

(a) when one car of said cars is at a last stop with doors open and is about to move into said parking space, providing at least one of a visual or audible message within said one car indicating that said one car is at its last stop and passengers should exit;

(b) closing the car doors; and (c) when said one car is at said last stop and has provided the at least one message of step (a) and thereafter closed its doors, providing at least one of a visual or audible message within said one car indicating that said one car is about to enter the parking space and passengers should press any car button.

2. A method of operating an elevator system including a plurality of cars movable within a hoistway having at least one parking space for parking an elevator car, said at least one parking space selected from a pit and an overhead which are capable of receiving one of said cars so as to avoid conflict between it and another of said cars, comprising the steps of:

(a) when one car of said cars is at a last stop with doors open and is about to move into said parking space, providing at least one of a visual or audible message within said one car indicating that said one car is at its last stop and passengers should exit;

(b) closing the car doors;

(c) when said one car is at said last stop and has provided the at least one message of step (a) and thereafter closed its doors, providing at least one of a visual or audible message within said one car indicating that said one car is about to enter the parking space and passengers should press any car button;

(d) moving said one car into said parking space;

(e) when said one car is in said parking space, providing at least one of a visual or audible message within said one car indicating that passengers should wait while another car serves other passengers; and (f) after said one car waits in said parking space, moving said one car to a terminal landing nearest said parking space and providing at least one of a visual audible message in said one car indicating that the passengers should exit next time the doors open and reenter their calls after exiting from said one car.

3. A method according to claim 2, wherein:

said message of (c) indicates that passengers should press any car button to open the doors.

4. A method of operating an elevator system including a plurality of cars movable within a hoistway having at least one parking space for parking an elevator car, said at least one parking space selected from a pit and an overhead which are capable of receiving one of said cars so as to avoid conflict between it and another of said cars, comprising the steps of:

(a) when one car of said cars is at a last stop with doors open and is about to move into said parking space, providing at least one of a visual or audible message within said one car indicating that said one car is at its last stop and passengers should exit;

(b) closing the car doors; and (c) moving said one car into said parking space.

5. A method according to claim 4, comprising (d) when said one car is in said parking space, providing at least one of a visual or audible message within said one car indicating that passengers should wait while another car serves other passengers.

6. A method according to claim 5, wherein:

said message of step (d) indicates that the passengers did not exit at the correct floor.

7. A method of operating an elevator system including a plurality of cars movable within a hoistway having at least one parking space for parking an elevator car, said at least one parking space selected from a pit and an overhead which are capable of receiving one of said cars so as to avoid conflict between it and another of said cars, comprising the steps of:

(a) when one car of said cars is at a last stop with doors open and is about to move into said parking space, providing at least one of a visual or audible message within said one car indicating that said one car is at its last stop and passengers should exit;

(b) closing the car doors;

(c) moving said one car into said parking space; and (d) after said one car waits in said parking space, moving said one car to a terminal landing nearest said parking space and providing at least one of a visual or audible message in said one car indicating that passengers should exit next time the doors open.

8. A method according to claim 7, wherein:

said message of step (d) indicates that passengers should reenter their calls after existing from said one car.

* * * * *